United States Patent [19]

Nebbia

[11] Patent Number: 4,902,015

[45] Date of Patent: Feb. 20, 1990

[54] GOLF PUTTER

[75] Inventor: David G. Nebbia, York Harbor, Me.

[73] Assignee: Panther Golf Corporation, Reading, Mass.

[21] Appl. No.: 200,550

[22] Filed: May 31, 1988

[51] Int. Cl.[4] ..... A63B 53/02

[52] U.S. Cl. ..... 273/168; 273/167 B; 273/167 C; 273/80.2; 273/164

[58] Field of Search ..... 273/168, 167 R, 167 B, 273/167 C, 167 D, 80.2, 167 J, 175, 174, 173, 172, 171, 170, 169, 168, 164; D21/216–219

[56] References Cited

U.S. PATENT DOCUMENTS

| | | | |
|---|---|---|---|
| D. 220,844 | 6/1971 | Letters | D21/219 |
| D. 264,367 | 5/1982 | Gida | D21/218 |
| D. 264,864 | 6/1982 | Hahn | D21/218 |
| D. 282,556 | 2/1986 | Slagle | D21/219 |
| 1,409,966 | 3/1922 | Plant | 273/168 |
| 3,394,937 | 7/1968 | Allport | 273/167 B |
| 4,147,357 | 4/1979 | Strop | 273/167 R |

FOREIGN PATENT DOCUMENTS

| | | | |
|---|---|---|---|
| 1129315 | 10/1968 | United Kingdom | 273/169 |

*Primary Examiner*—Edward M. Coven
*Assistant Examiner*—Valerie Szczepanik
*Attorney, Agent, or Firm*—William Nitkin

[57] ABSTRACT

A golf putter head having rounded front and rear faces with a flattened top and bottom, being generally cylindrical with a bracket held thereto by bracket extensions affixed into the flattened top of the putter head with a club shaft receipt aperture disposed in a central portion of the top of the bracket.

2 Claims, 1 Drawing Sheet

GOLF PUTTER

BACKGROUND OF THE INVENTION

1. Field of the Invention

The device of this invention is a golf putter and more particular relates to an improved golf putter head construction.

2. Description of the Prior Art

Golf putters are well known in the prior art and usually comprise a head which is attached to a shaft with a handgrip at the end thereof. Commonly golf putter heads have a flat front face and sometimes a parallel flat rear face and such putters are usuable by both right-handed and left-handed golfers.

SUMMARY OF THE INVENTION

It is an object of this invention to provide a new design for a golf putter head which improves the putting characteristics of the putter and allows use of such club by both right-handed and left-handed golfers.

It is a further object of this invention to provide a golf putter with characteristics which will give a topspin to a golf ball struck by such putter for greater accuracy when putting.

It is yet still a further object of this invention to provide a putter with improved resistence to angular positioning and movement which angular positioning and movement might adversely affect the direction of movement of the golf ball after impact.

DESCRIPTION OF THE PREFERRED EMBODIMENT(S)

Figure 1:
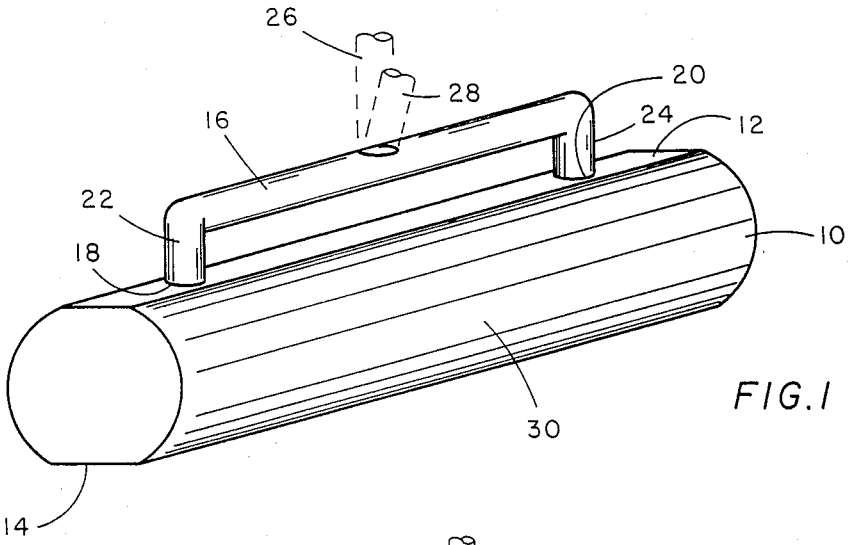
FIG. 1 illustrates a perspective view of the golf putter head of this invention.
Figure 2:
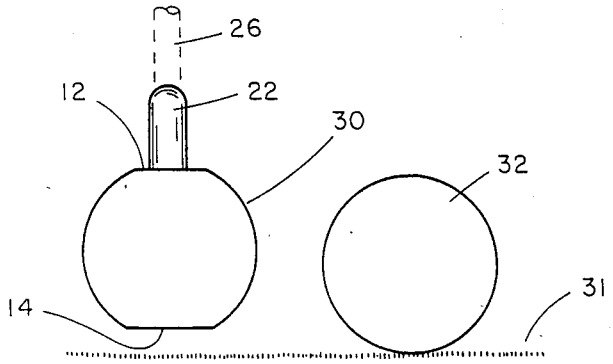
FIG. 2 illustrates an end view of the golf putter head of this invention about to strike a ball.

FIG. 1 illustrates putter head 10 of this invention. The putter head is generally cylindrical with a flattened top and bottom. Seen in this view is rounded front face 30. The rear race of the putter head is also rounded. It has been found that a rounded face presents a narrow point of contact of the club with the ball being the point where the curve of the face of the putter head contacts the curve of the ball and this narrower point of contact increases the sensitivity of the putter and the control of the putt which a flat-faced club does not provide. It is the rounded front face 30 of the putter head which is one of the aspects of the improvements herein to provide topspin to the ball when struck such as may be visualized in FIG. 2 which shows putter face 30 about to strike ball 32. The putter head of this invention has a metal or equivalent body which is approximately 4 inches in length and, as mentioned above, is substantially cylindrical being approximately 1¼ inches in diameter. bottom 14 of the putter head is machined flat and is approximately ¾ inch wide. The top 12 of the putter head is also machined flat and is approximately ½ inch wide. On the top of the putter head are bored two ½ inch deep apertures such as bracket extension apertures 18. These bracket extension apertures are disposed apart from one another a distance equidistant from a center point on the top of the putter head and into these apertures is positioned bracket 16 which is a rod member disposed horizonally and in parallel relationship to the top face 12 of the putter head, such bracket having first bracket extension 22 and second bracket extension 24 extending at right angles therefrom directed down into and each affixed respectively within one of bracket extension apertures. At the top of bracket 16 is defined a shaft aperture for receipt of the shaft of the club, such shaft shown in outline form. Club shafts and handgrips are well known structures in the art. The shaft apertures in which the club shaft is disposed within bracket 16 can be either vertically aligned so that the shaft extends out from the bracket 16 in a vertical direction such as vertical shaft 26 or such aperture can be angularly positioned so that the shaft extends out of the bracket in an angular direction such as angular shaft 28. Bracket 16 is approximately 3 inches long and the bracket extension apertures can be disposed approximately ½ inch from each end of putter head 10 causing bracket 16 to be centered on the top 12 of the putter head so that each bracket extension is positioned approximately ½ inch from the ends of putter head 10, and the aperture defined in the top portion of bracket 16 is further centered on bracket 16 from each end so that the club shaft is attached therein at a point that is balanced and central to the entire putter head structure. Flattened bottom 14 of the putter head allows the user to position face 30 so that the area beneath the flat bottom is sufficient to allow the maneuvering of the club over ground 31 while at the same time allowing the foremost portion of rounded front face 30 to contact the rearmost portion of ball 32 to accomplish a sharp contact and improved directional striking thereof. It has been found that the shaft can be either installed in bracket 16 in either a vertical position such as shaft 26 or in an angular position such as shaft 28. The positioning of bracket extensions 22 and 24 into apertures positioned near the ends of the putter head limit the rotational movement of the putter by the user more so than if the shaft were merely attached directly into putter head 10. Further, the bracket retains the end of the club shaft effectively above the cylindrical body of the putter head.

Figure 3:
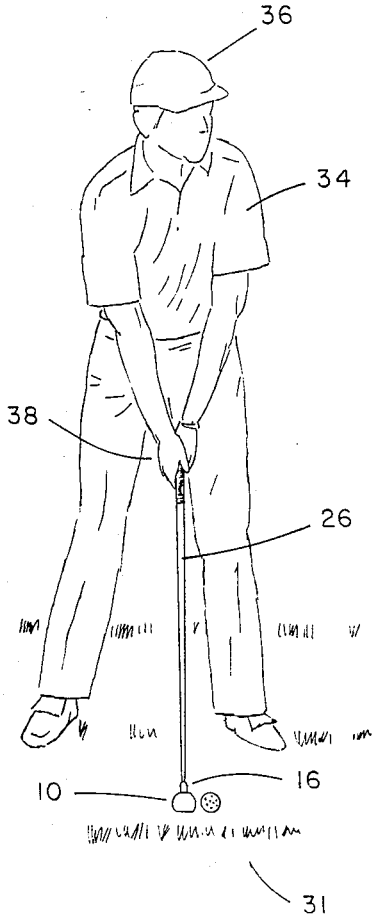
FIG. 3 illustrates a golfer aligning a putt using a putter with the putter head design of this invention.

In FIG. 3 golfer 36 grips the end of the club which has shaft 26 extending down to the putter head 10 through bracket 16. The ball on ground 31 is struck as in normal putting practice. The putter head of this invention presents significant advantages over that of the prior art in that the rounded front and rear faces and the elevated bracket above the putter head give the user improved control over his putt.

Although the present invention has been described with reference to particular embodiments, it will be apparent to those skilled in the art that variations and modifications can be substituted therefor without departing from the principles and spirit of the invention.

I claim:

1. An improved golf putter of the type having a club shaft attached thereto comprising:

a putter head being generally cylindrical in shape having a flattened top and bottom forming an upper flat face and a lower flat face, first and second ends, and curved front and rear faces;

a bracket member having a top and bottom with first and second extension members extending downward form the ends thereof, said extension members disposed at right angles to said bracket member, said bracket member having a length approximatley three-quarters the length of said putter head;

a pair of apertures defined in said upper flat face of said putter head, said apertures being disposed equidistant from the ends of the putter head and spaced apart the same distance as the distance said bracket extension members are spaced apart from one another;

said bracket extension members inserted into said pair of apertures on the upper flat face of said putter head and affixed to said putter head;

a shaft aperture defined in the center of the top of said bracket member for receipt of the shaft of the club.

2. The golf putter of claim 1 wherein the diameter of said cylindrical putter head is approximately $1\frac{1}{4}$ inches and the length of said putter head is approximately 4 inches with said upper flat face of said putter head being approximately $\frac{1}{2}$ inch in width and the lower flat face of said putter head being approximately $\frac{3}{4}$ inch in width with said bracket member being approximately 3 inches in length with the apertures defined in the top of said flat face of said putter head being spaced apart approximately 3 inches from one another disposed equidistant from the ends of said putter head with the aperture defined in said bracket member being centrally disposed in the top of said bracket member for receipt therein of said shaft, said shaft being positioned at an angle if desired.

* * * * *